US009622545B2

(12) United States Patent
Bell et al.

(10) Patent No.: US 9,622,545 B2
(45) Date of Patent: Apr. 18, 2017

(54) DUAL-MOLDED LAYER OVERSHOE

(71) Applicant: Joneric Products Inc., Horsham, PA (US)

(72) Inventors: Jordan David Bell, Lafayette Hill, PA (US); Jonathan Marc Bell, Maple Glen, PA (US)

(73) Assignee: Joneric Products, Inc., Horsham, PA (US)

( * ) Notice: Subject to any disclaimer, the term of this patent is extended or adjusted under 35 U.S.C. 154(b) by 25 days.

(21) Appl. No.: 14/605,546

(22) Filed: Jan. 26, 2015

(65) Prior Publication Data

US 2016/0213092 A1 Jul. 28, 2016

(51) Int. Cl.
*A43C 15/06* (2006.01)

(52) U.S. Cl.
CPC ..... *A43C 15/066* (2013.01); *A43C 15/063* (2013.01)

(58) Field of Classification Search
CPC ..... A43B 13/36; A43C 15/02; A43C 15/161; A43C 15/00; A43C 15/005; A43C 15/04; A43C 15/06
USPC ..... 36/62, 59 R
See application file for complete search history.

(56) References Cited

U.S. PATENT DOCUMENTS 2,049,598 A * 8/1936 Tubbs ..... A43B 5/1641 280/11.3
2,157,561 A * 5/1939 Oakland ..... A43C 15/02 36/64
2,290,792 A * 7/1942 Abbott ..... A43C 15/161 12/142 P
2,608,007 A * 8/1952 Shapiro ..... A43B 5/06 36/129
2,658,289 A * 11/1953 Schrieber ..... A43C 15/063 36/17 R
2,803,070 A * 8/1957 Passidomo ..... A43C 15/161 36/59 R
2,918,733 A * 12/1959 Anderson ..... A43C 15/165 36/114
3,566,489 A * 3/1971 Morley ..... A43C 15/00 36/67 D
3,583,082 A * 6/1971 Fordan, Jr. ..... A43D 100/14 36/129

(Continued)

OTHER PUBLICATIONS

Author Unknown, "Stabilicers Run," 34North, [retrieved on Jan. 21, 2015] 2 pages. Retrieved from: https://www.32north.com/icers/3-stabilcers-sportsrunners-ice-cleats.html.

*Primary Examiner* — Shaun R Hurley
*Assistant Examiner* — Bao-Thieu L Nguyen
(74) *Attorney, Agent, or Firm* — Holzer Patel Drennan

(57) ABSTRACT

The technology disclosed herein includes a dual-molded layer overshoe apparatus comprising a cleat, a sole layer configured to receive the cleat, and an upper layer, wherein the upper is molded to the sole layer and the upper layer has a lower durometer than the sole layer, and wherein the plurality of pin plates are secured between the sole layer and the upper layer. Significant elasticity in the upper layer allows stretch for installation and removal. Reduced elasticity in the sole layer offers greater durability in terms of spike retention and abrasion resistance. In one implementation, the components are assembled in one contiguous, fixed arrangement, wherein the cleat is molded into the sole layer, and the upper layer is then molded to the sole layer.

20 Claims, 5 Drawing Sheets

(56) References Cited

U.S. PATENT DOCUMENTS 3,597,864 A * 8/1971 MacNeill ..... A43B 5/001 36/57
3,605,291 A * 9/1971 Moore et al. ..... A43B 3/163 36/7.1 R
3,616,552 A * 11/1971 Kniffin ..... A43C 15/165 36/59 R
3,914,882 A * 10/1975 Greer ..... A43C 15/063 36/62
4,246,707 A * 1/1981 Pedersen ..... A43B 3/16 36/100
5,359,789 A * 11/1994 Bell ..... A43C 15/00 36/11.5
5,634,283 A * 6/1997 Kastner ..... A43C 15/00 36/15
5,638,615 A * 6/1997 Korsen ..... A43B 3/0042 36/134
5,659,978 A 8/1997 Bell et al.
5,709,042 A * 1/1998 Houdroge ..... A43C 15/063 36/62
5,794,360 A 8/1998 Bell et al.
5,813,143 A 9/1998 Bell et al.
5,836,091 A * 11/1998 Cook ..... A43C 15/02 152/208
5,921,005 A * 7/1999 Bell ..... A43C 15/02 36/11.5
5,960,568 A 10/1999 Bell et al.
6,058,627 A * 5/2000 Violette ..... A43C 15/14 36/59 R
6,154,982 A * 12/2000 Bell ..... A43B 5/18 36/7.3
6,698,110 B1 * 3/2004 Robbins ..... A43B 5/185 36/134
6,915,595 B2 * 7/2005 Kastner ..... A43C 15/02 36/59 C
7,353,627 B2 * 4/2008 Briant ..... A43B 5/02 36/134
D628,372 S 12/2010 Bell et al.
8,250,779 B2 8/2012 Bell et al.
RE44,193 E * 5/2013 Larson ..... A43B 3/16 36/59 R
8,567,096 B2 * 10/2013 Scholz ..... A43B 3/24 36/134
2002/0029495 A1 * 3/2002 Kastner ..... A43C 15/005 36/59 R
2004/0045190 A1 * 3/2004 Washburn ..... A43C 15/162 36/7.6
2005/0217149 A1 * 10/2005 Ho ..... A43C 15/161 36/59 R
2007/0113424 A1 * 5/2007 Bell ..... A43B 3/16 36/7.3
2011/0047829 A1 3/2011 Bell et al.
2011/0252664 A1 * 10/2011 Jennings ..... A43B 5/02 36/28
2012/0317840 A1 * 12/2012 Wojnar ..... A43B 13/22 36/103

* cited by examiner

DUAL-MOLDED LAYER OVERSHOE

BACKGROUND

Conventional footwear (e.g., work boots, athletic shoes, ski boots, etc.) often provides inadequate traction under certain environmental conditions (e.g., inclement or slippery surfaces). For example, even work boots, which often provide rugged tread on the bottom of their soles, may lack adequate fraction on an icy surface, such as a frozen construction site or highway. The drawbacks of moving across a soft or a slippery surface include risk of falls, injury, and/or inconvenience. Overshoes that provide traction can improve stability and reduce slipping in a variety of environmental conditions.

Conventional cleats or pin inserts may be used in overshoes, protruding from the bottom of the sole of the overshoe. A user of the overshoe pushes the cleats into a ground surface to grip the surface as the user stands or walks. However, the protruding nature of the cleats renders them vulnerable to wear or damage. For example, walking on hard surfaces or the installation and removal process can cause loosen or cause damage to the cleat.

SUMMARY

The technology disclosed herein includes a dual-molded layer overshoe comprising a cleat, a sole layer configured to receive the cleat, and an upper layer, wherein the upper is molded to the sole layer and the upper layer has a lower durometer measurement than the sole layer, and wherein the cleat is secured between the sole layer and the upper layer. Significant elasticity in the upper layer allows stretching for installation and removal. Reduced elasticity in the sole layer offers greater durability in terms of spike retention and abrasion resistance. In one implementation, the components are assembled in one contiguous, fixed arrangement, wherein the cleat is molded into the sole layer, and the upper layer is then molded to the sole layer over the cleats.

This Summary is provided to introduce an election of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations and implementations as further illustrated in the accompanying drawings and defined in the appended claims.

BRIEF DESCRIPTIONS OF THE DRAWINGS

DETAILED DESCRIPTION

Overshoes are typically worn over primary footwear (e.g., a shoe). However, overshoes can also be used without covering a primary shoe, and used directly on top of a user's foot. When used over primary footwear, the overshoe includes an upper layer that attaches to the top and sides of the footwear, and a sole layer that underlies the sole of the footwear. The sole layer is sized to accommodate the sole of the primary footwear and is shaped with a perimeter that is roughly the shape of a shoe or boot sole. When worn, the sole layer underlies a forefoot region, a mid-foot region, and a hind-foot region of the user's primary footwear.

The technology disclosed herein includes an apparatus, system, and method of manufacturing for a dual-molded layer overshoe. Specifically, the disclosed overshoe comprises a cleat, a sole layer configured to receive the cleat, and an upper layer, wherein the upper layer is molded to the sole layer and has a lower durometer measurement than the sole layer, and wherein the cleat is secured between the sole layer and the upper layer. The technology disclosed herein provides for a compact, industrial strength walking device for adverse environmental conditions, such as ice and snow, that provides improved cold weather flexibility, enhanced traction sole surfaces and protection, resists slippage, and fits easily and conveniently over all types of footwear.

Figure 1:
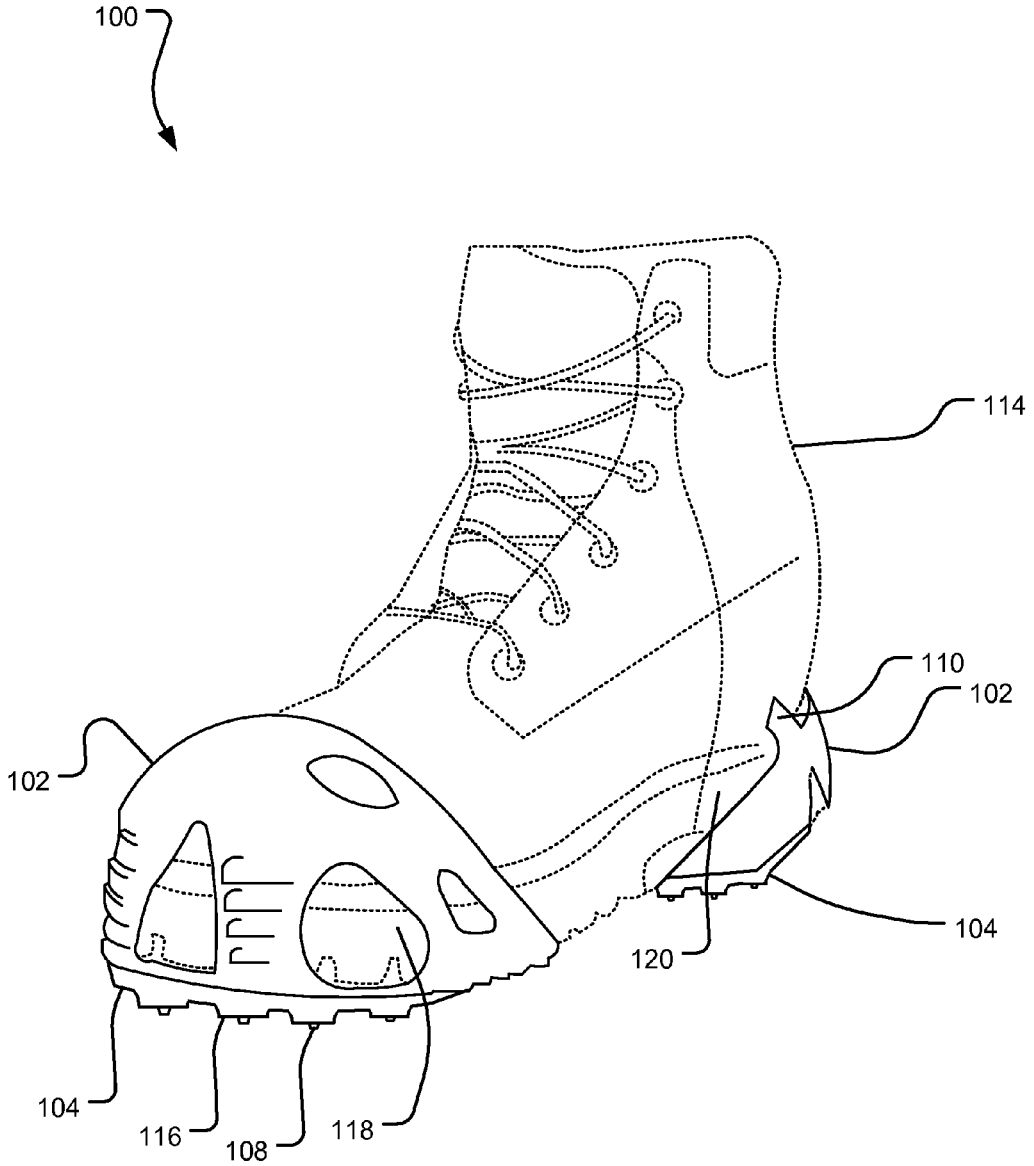
FIG. 1 illustrates a perspective view of an example dual-molded layer overshoe attached to a shoe.

FIG. 1 illustrates a perspective view of an example dual-molded layer overshoe 100 in use. The overshoe 100 is attached to footwear (e.g., boot 114) to provide traction and mobility for the boot 114 in various environmental conditions (e.g., snow, ice, grass, rock, etc.). The boot 114 can comprise of a variety of shoes, boots, athletic apparel, industrial gear, etc, for example.

As shown in FIG. 1, a sole layer 104 is attached to the bottom of an upper layer 102 to form the overshoe 100. The sole layer 204 is molded to the upper layer 10. A permanent attachment results in maximum traction during use without risk of detachment of the sole layer 104 from the upper layer 102. The sole layer 104 and upper layer 102 may be made of a variety of materials including resilient materials (e.g., rubber, polyvinyl chloride, synthetic rubber, thermal plasticized rubber, thermoplastic elastomer, etc.).

The upper layer 102 has a lower durometer (or hardness) measurement (e.g., a range of 30-50 A) than the sole layer 104 (e.g., a range of 75-95 A). This combination of different hardness measurements provides for structural integrity as well as flexible function of the overshoe 100. A lower durometer upper layer 102 provides improved cold weather flexibility and stretching of the overshoe 100 for removal and installation to the boot 114. Reduced elasticity in the higher durometer sole layer offers greater durability in terms of cleat (or pin) retention and abrasion resistance of the overshoe 100. As shown, the upper layer 102 covers and secures a toe area 118 and a heel area of the footwear 114 in a form-fitting manner. The sole layer 104 underlies the upper layer 102. The upper layer 102 is generally stretchable by a wearer or user of the footwear 114. In some implementations, the upper layer 102 is made of an elastic material, although other non-elastic materials may be used as well.

The upper layer 102 may be stretched when the user puts the upper layer 102 onto the footwear 114 and not stretched (or less stretched) when in place on the footwear 114. During installation, a front portion of an overshoe 100 and/or the back portion of the overshoe 100 may be stretched to allow for insertion of the boot 114. The sole layer 104, which has a higher durometer measurement than the upper layer 102, is generally disposed under the toe portion (not shown) and the heel portion (not shown) of the primary footwear 114. During removal, a front portion of an overshoe 100, and/or the back portion of the overshoe 100, may be stretched to allow the overshoe 100 to detach from the boot 114. A higher durometer sole layer 104 offers greater durability in terms of cleat (or pin) retention and abrasion resistance. In one implementation, the sole layer 104 can also be aggressively treaded.

The upper layer 102 and the sole layer 104 may comprise of one or more additional segments or portions. For example, there is a pull-tab 110 shown as part of the upper layer 102. The pull-tab assists in removal of the overshoe from the boot 114. The stretchability or elasticity of the low durometer upper layer allows for quick removal from the boot 114, and a pull-tab further decreases removal time and/or user effort. Additionally, the sole layer 104 has lug portions (e.g., lug portion 116) on the bottom of the sole layer 104.

At least one cleat (e.g., cleat 108) is inserted in the top surface of the harder sole layer 104, and located in between the sole layer and the upper layer. The cleat (e.g., grass cleat, bicycle cleat, or ice cleat) may be one or more components that extend from inside of the overshoe 100 through the bottom surface of the overshoe 100. The cleat is a rigid or a semi-rigid projection, which contacts a ground surface and grips the surface providing traction to a user wearing the overshoe 100. The placement of the cleat can vary. The cleat may be placed to protrude from the bottom surface of the sole layer, underlying a forefoot region, a mid-foot region, and/or a hind-foot region of a user's foot.

In one implementation, the cleat may be one component. For example, the cleat may resemble a tack and be continuous in material. In another implementation, the cleat may include several components, such as a pin plate with one or more pins inserted in the pin plate and extending out of the pin plate, and through the bottom surface of the sole layer to contact a ground surface. The pin plate may be molded into the sole layer or attached by other mechanisms. The one or more pins may be studs, spikes, screws, etc., for example. The pins may also be made of a variety of materials (e.g., metal alloys, aluminum, tungsten, stainless steel, plastic, or other suitable materials). There may be one pin centered and embedded in each pin plate, or more than one pin in embedded in each pin plate.

In the implementation shown in FIG. 1, there are four pins (e.g., pin 108) depicted near the front of the overshoe 100, extending out of the bottom surface of lug portions (e.g., lug portion 116) of the sole layer 104, and protruding from the pin plates (not shown). The shape of the pins or cleats can vary (e.g., cylindrical, rectangular, etc.).

The pins (or cleats), which can vary in number, provide traction in the overshoe 100. In one implementation, a pin is molded into a pin plate, and the pin plate is molded into the sole layer. As a result, this configuration provides aggressive snow tread and improved spike retention preventing loss of the pin.

In one implementation, an overshoe may have 26 exposed tungsten carbide pins and corresponding pin plates. The pins can vary in distance projecting from the corresponding lugs of the overshoe 100 (e.g., 1 mm, 2 mm, etc.). For example, a pin projection of about 2.5 mm offers aggressive traction. In another example, a pin projection of about 1 mm offers sufficient traction and can be used for walking indoors or for transitional traction (i.e., traction in both indoor and outdoor environments).

In one implementation, the pins may be separate components from the pin plates and attached to the pin plates by interference fit, molding, or other means. For example, the pins may be metal pins that are molded into plastic pin plates. Molding of the pins into the pin plates in a fixed arrangement provides durability and allows users to use the overshoe with confidence.

Further, the pins may be positioned in the pin plates, wherein a majority of each pin is located in a pin plate, and a smaller portion of the pin protrudes down through the bottom surface of the lug portion of the sole layer 104, and into a ground surface during use.

The pin plates may be located in a variety of configurations in the sole layer 104 and the upper layer 102. In one implementation, the pin plates may be positioned entirely in the sole layer 104, with the upper layer 102 having contact with only the top surface of the pin plates. In yet another implementation, the pin plates may be located in both the sole layer 104, and the upper layer 102. In either of these two implementations, there may be at least a portion of upper layer 102 material above the top surface of the pin plates to provide cushioning for the user's foot for comfort and to avoid unwanted fatiguing.

Figure 2:
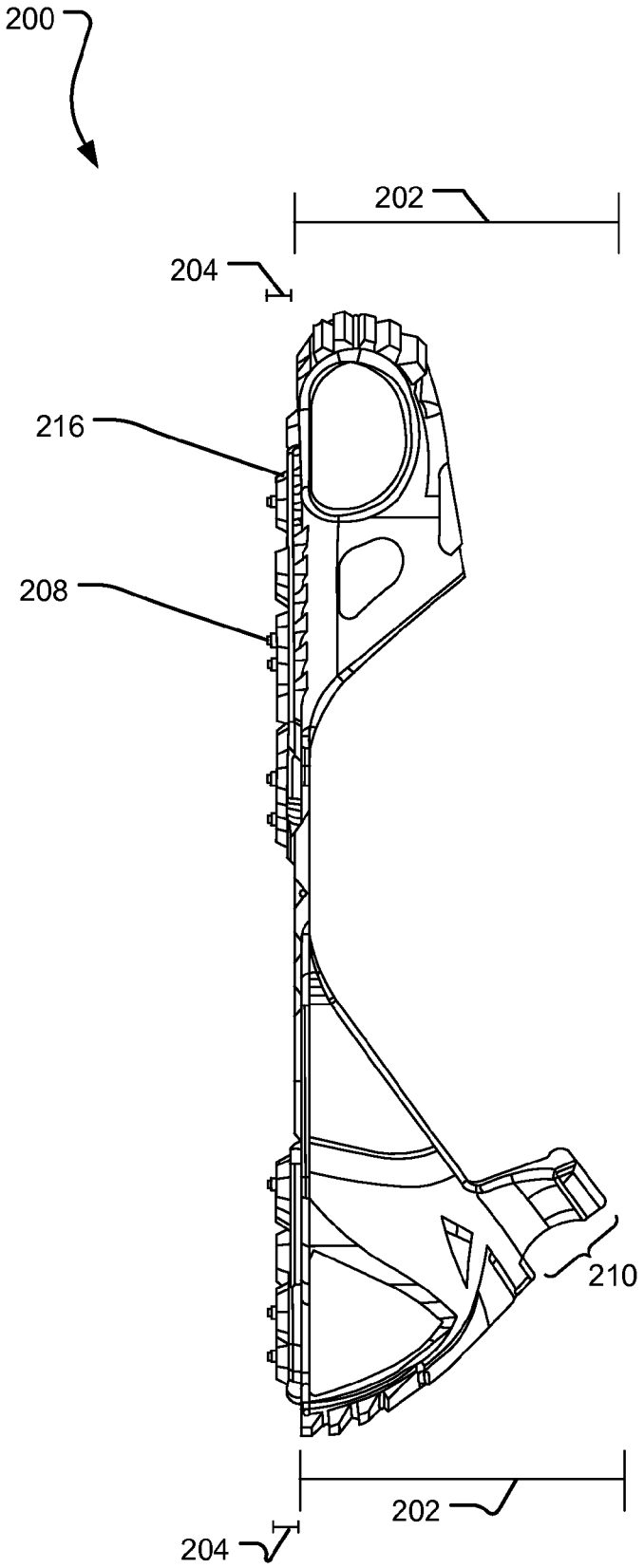
FIG. 2 illustrates a side view of an example dual-molded layer overshoe.

FIG. 2 illustrates a side of view of an example dual-molded layer overshoe 200. An upper layer 202 is shown as the upper portion of the overshoe apparatus 200. A rear pull-tab 210 is attached as part of the top back portion of the upper layer 202, for assisting removal of the apparatus 200 when it is in use. In certain implementations, there may or may not be a pull-tab.

As shown in FIG. 2, a sole layer 204 is attached to the bottom of the upper layer 202 to form the overshoe 200. The sole layer 204 may be molded. A permanent attachment results in maximum traction during use without risk of detachment of the sole layer 204 from the upper layer 202. The sole layer 204 and upper layer 202 may be made of a variety of materials including resilient materials (e.g., rubber, polyvinyl chloride, synthetic rubber, thermal plasticized rubber, thermoplastic elastomer etc.).

The upper layer 202 has a lower durometer (or hardness) measurement (e.g., a range of 30-50 A) than the sole layer 204 (e.g., a range of 75-95 A). This combination of different hardness measurements provides for structural integrity as well as flexible function of the overshoe 200. A lower durometer upper layer 202 provides improved cold weather flexibility and stretching of the overshoe 200 for removal and installation to footwear. Reduced elasticity in the higher durometer sole layer offers greater durability in terms of cleat (or pin) retention and abrasion resistance of the overshoe 200.

The upper layer 202 and the sole layer 204 may comprise of one or more additional segments or portions. For example, there is a pull-tab 210 shown as part of the upper layer 202. The pull-tab assists in removal of the overshoe from footwear. The stretchability or elasticity of the low durometer upper layer allows for quick removal from the footwear, and a pull-tab further decreases removal time and/or user effort. Additionally, the sole layer 204 has lug portions (e.g., lug portion 216) on the bottom of the sole layer 204.

At least one cleat (e.g., cleat 208) is inserted in the harder sole layer 204, and located in between the sole layer and the upper layer. The cleat (e.g., grass cleat, bicycle cleat, or ice cleat) may be one or more components that extend from inside of the overshoe 200 through the bottom surface of the overshoe 200. The cleat is a rigid or a semi-rigid projection, which contacts a ground surface and grips the surface providing traction to a user wearing the overshoe 200. The placement of the cleat can vary. The cleat may be placed to protrude from the bottom surface of the sole layer, underlying a forefoot region, a mid-foot region, and/or a hind-foot region of a user's foot.

In one implementation, the cleat may be one component. For example, the cleat may resemble a tack and be continuous in material. In another implementation, the cleat may include several components, such as a pin plate (not shown) with one or more pins (e.g., pin 208) inserted in the pin plate and extending out of the pin plate, and through the bottom surface of the sole layer to contact a ground surface. The pin plate may be molded into the sole layer or attached by other mechanisms. The one or more pins may be studs, spikes, screws, etc., for example. The pins may also be made of a variety of materials (e.g., metal alloys, aluminum, tungsten, stainless steel, plastic, or other suitable materials). There may be one pin centered and embedded in each pin plate, or more than one pin in embedded in each pin plate.

In the implementation shown in FIG. 2, there are eight pins (e.g., pin 208) depicted, extending out of the bottom surface of lug portions (e.g., lug portion 216) of the sole layer 204, and protruding from the pin plates (not shown). The shape of the pins or cleats can vary (e.g., cylindrical, rectangular, etc.).

In FIG. 2, the pins are positioned wherein a majority of the pins 208 are located in the lug portions 216, and the smaller portion of the pins 208 protrudes down through the bottom surface of the lug portions 216 of the sole layer 204, and into a ground surface during use.

The pin (or cleat), which can vary in number, provide fraction in the overshoe 100. In one implementation, a pin is molded into a pin plate, and the pin plate is molded into the sole layer. As a result, this configuration provides aggressive snow tread and improved spike retention preventing loss of the pin (or spike).

In one implementation, an overshoe may have 26 exposed tungsten carbide pins and corresponding pin plates. The pins can vary in distance projecting from the corresponding lugs of the overshoe 200 (e.g., 1 mm, 2 mm, etc.). For example, a pin projection of about 2.5 mm offers aggressive traction. In another example, a pin projection of about 1 mm offers sufficient traction and can be used for walking indoors or for transitional traction (i.e., traction in both indoor and outdoor environments).

The pin plates may be located in a variety of configurations in the sole layer and the upper layer. The pin plates may be positioned entirely in the sole layer, with the upper layer having contact with only the top surface of the pin plates. In yet another implementation, the pin plates may be located in both the sole layer, and the upper layer.

Figure 3:
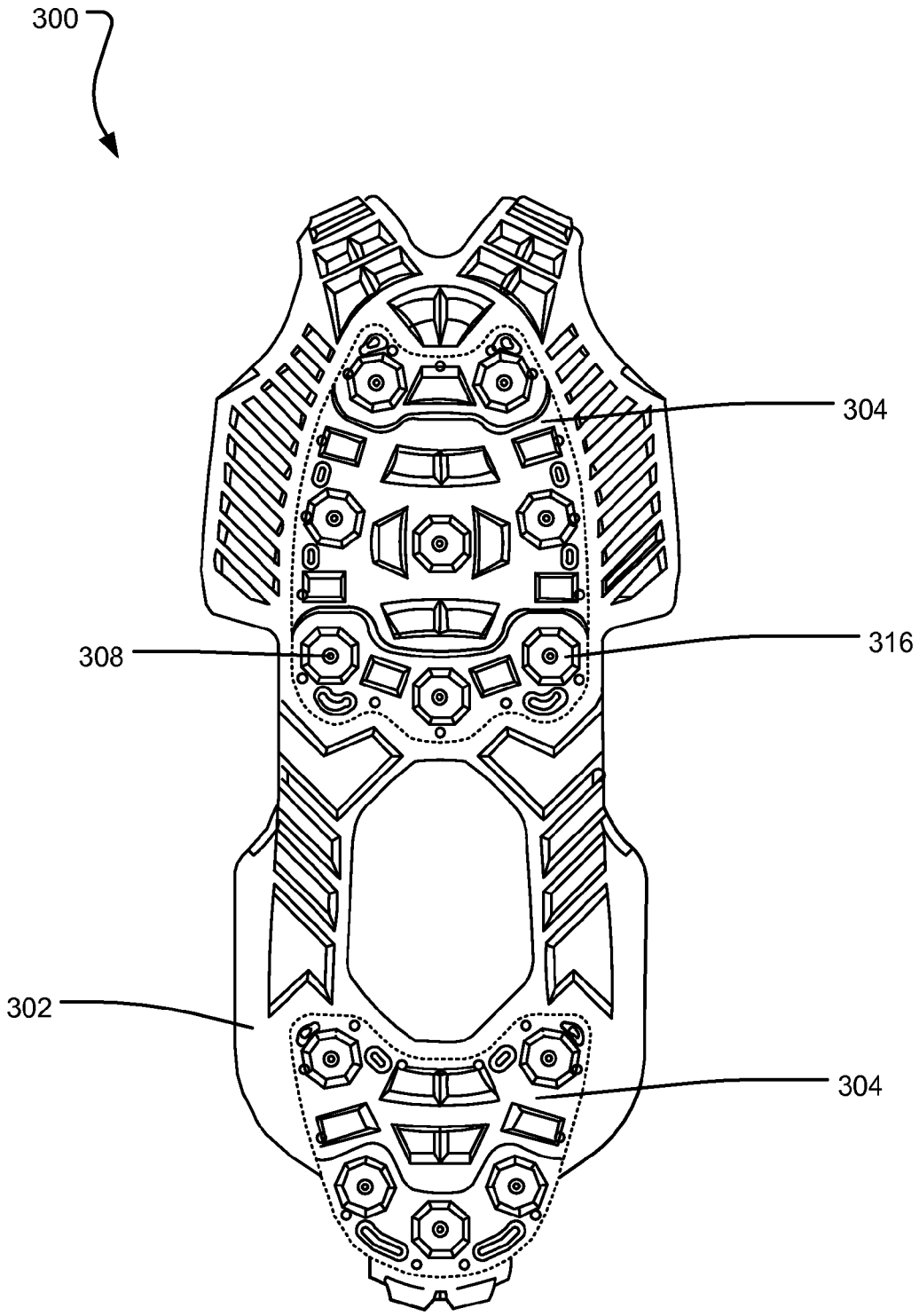
FIG. 3 illustrates a bottom view of an example dual-molded layer overshoe.

FIG. 3 illustrates a bottom view of an example dual-molded layer overshoe 300. As shown, a sole layer 304 may be molded to the bottom of an upper layer 302. The sole layer 304 underlies the sole of footwear. A permanent attachment results in traction during use without risk of detachment of the sole layer 304 from the upper layer 302. The sole layer 304 and upper layer 302 may be made of a variety of materials including resilient materials (e.g., rubber, polyvinyl chloride, synthetic rubber, thermal plasticized rubber, thermoplastic elastomer, etc.).

The upper layer 302 has a lower durometer measurement than the sole layer 304. The stretchability or elasticity of the low durometer upper layer allows for quick removal from the foot. A higher durometer sole layer 304 offers greater durability in terms of cleat (or pin) retention and abrasion resistance.

The upper layer 302 has a lower durometer (or hardness) measurement (e.g., a range of 30-50 A) than the sole layer 304 (e.g., a range of 75-95 A). This combination of different hardness measurements provides for structural integrity as well as flexible function of the overshoe 300. A lower durometer upper layer 302 provides improved cold weather flexibility and stretching of the overshoe 300 for removal and installation to footwear. Reduced elasticity in the higher durometer sole layer offers greater durability in terms of cleat (or pin) retention and abrasion resistance of the overshoe 300. The upper layer 302 is generally stretchable by a wearer or user. In some implementations, the upper layer 302 is made of an elastic material, although other non-elastic materials may be used as well.

The upper layer 302 and the sole layer 304 may comprise of one or more additional segments or portions. For example, in this implementation, the sole layer 304 has lug portions (e.g., lug portion 316) on the bottom of the sole layer 304. Also, the sole layer 304 is shown as two separate components. The upper layer 302 in this implementation is one component.

At least one cleat (e.g., cleat 308) is inserted in the harder sole layer 304, and located in between the sole layer and the upper layer. The cleat (e.g., grass cleat, bicycle cleat, or ice cleat) may be one or more components that extend from inside of the overshoe 300 through the bottom surface of the overshoe 300. The cleat is a rigid or a semi-rigid projection, which contacts a ground surface and grips the surface providing traction to a user wearing the overshoe 300. The placement of the cleat can vary. The cleat may be placed to protrude from the bottom surface of the sole layer, underlying a forefoot region, a mid-foot region, and/or a hind-foot region of a user's foot.

In one implementation, the cleat may be one component. For example, the cleat may resemble a tack and be continuous in material. In another implementation, the cleat may include several components, such as a pin plate (not shown) with one or more pins (e.g., pin 308) inserted in the pin plate and extending out of the pin plate, and through the bottom surface of the sole layer to contact a ground surface. The pin plate may be molded into the sole layer or attached by other mechanisms. The one or more pins may be studs, spikes, screws, etc., for example. The pins may also be made of a variety of materials (e.g., metal alloys, aluminum, tungsten, stainless steel, plastic, or other suitable materials). There may be one pin centered and embedded in each pin plate, or more than one pin in embedded in each pin plate.

In the implementation shown in FIG. 1, there are four pins (e.g., pin 308) depicted near the front of the overshoe 300, extending out of the bottom surface of lug portions (e.g., lug portion 316) of the sole layer 304, and protruding from the pin plates (not shown). The shape of the pins or cleats can vary (e.g., cylindrical, rectangular, etc.).

The pins (or cleats), which can vary in number, provide traction in the overshoe 300. In one implementation, a pin is molded into a pin plate, and the pin plate is molded into the sole layer. As a result, this configuration provides aggressive snow tread and improved spike retention preventing loss of the pin.

In one implementation, an overshoe may have 26 exposed tungsten carbide pins and corresponding pin plates. The pins can vary in distance projecting from the corresponding lugs of the overshoe 300 (e.g., 1 mm, 2 mm, etc.). For example, a pin projection of about 2.5 mm offers aggressive traction. In another example, a pin projection of about 1 mm offers sufficient traction and can be used for walking indoors or for transitional traction (i.e., traction in both indoor and outdoor environments).

In one implementation, the pins may be separate components from the pin plates and attached to the pin plates by interference fit, molding, or other means. For example, the pins may be metal pins that are molded into plastic pin plates. Molding of the pins into the pin plates in a fixed arrangement provides durability and allows users to use the overshoe 300 with confidence.

Further, the pins may be positioned in the pin plates, wherein a majority of each pin is located in a pin plate, and a smaller portion of the pin protrudes down through the bottom surface of the lug portion of the sole layer 304, and into a ground surface during use. In another implementation, the pin plates may be located in a variety of configurations in the sole layer 304 and the upper layer 302. The pin plates may be positioned entirely in the sole layer 304, with the upper layer 302 having contact with only the top surface of the pin plates. In yet another implementation, the pin plates may be located in both the sole layer 304, and the upper layer 302.

Figure 4:
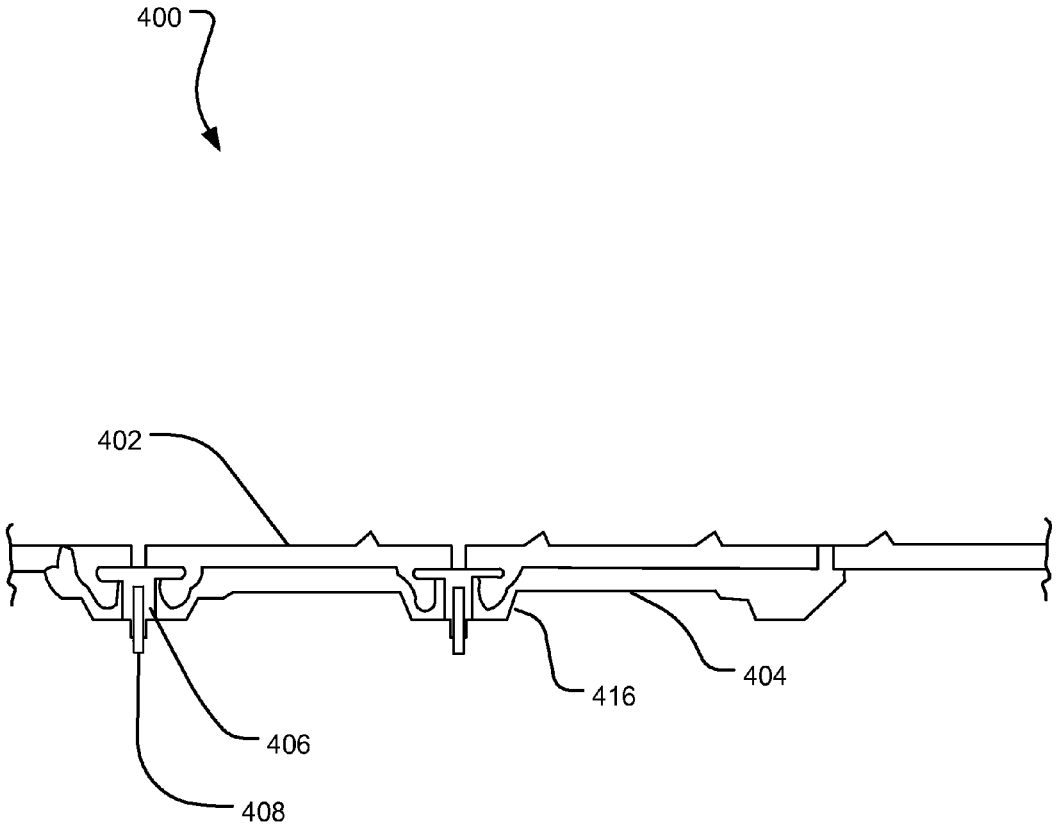
FIG. 4 illustrates a partial cross-sectional side elevation view of an example dual-molded layer overshoe.

FIG. 4 illustrates a partial cross-sectional side elevation view of an example dual-molded layer overshoe 400. As shown in FIG. 4, a sole layer 404 is attached to the bottom of an upper layer 402 to form the overshoe 400. The sole layer 404 is molded to the upper layer 402. A permanent attachment results in maximum traction during use without risk of detachment of the sole layer 404 from the upper layer 402. The sole layer 404 and upper layer 402 may be made of a variety of materials including resilient materials (e.g., rubber, polyvinyl chloride, synthetic rubber, thermal plasticized rubber, thermoplastic elastomer, etc.).

The upper layer 402 has a lower durometer (or hardness) measurement (e.g., a range of 30-50 A) than the sole layer 404 (e.g., a range of 75-95 A). This combination of different hardness measurements provides for structural integrity as well as flexible function of the overshoe 400. A lower durometer upper layer 402 provides improved cold weather flexibility and stretching of the overshoe 400 for removal and installation to footwear. Reduced elasticity in the higher durometer sole layer offers greater durability in terms of cleat (or pin) retention and abrasion resistance of the overshoe 400.

The upper layer 402 and the sole layer 404 may comprise of one or more additional segments or portions. For example, the sole layer 404 has lug portions (e.g., lug portion 416) on the bottom of the sole layer 404.

At least one cleat (e.g., cleat 408) is inserted in the harder sole layer 404, and located in between the sole layer and the upper layer. The cleat (e.g., grass cleat, bicycle cleat, or ice cleat) may be one or more components that extend from inside of the overshoe 400 through the bottom surface of the overshoe 400. The cleat is a rigid or a semi-rigid projection, which contacts a ground surface and grips the surface providing traction to a user wearing the overshoe 400. The placement of the cleat can vary. The cleat may be placed to protrude from the bottom surface of the sole layer, underlying a forefoot region, a mid-foot region, and/or a hind-foot region of a user's foot.

In one implementation, the cleat may be one component. For example, the cleat may resemble a tack and be continuous in material. In another implementation, the cleat may include several components, such as a pin plate (e.g., pin plate 406) with one or more pins (e.g., pin 408) inserted in the pin plate and extending out of the pin plate, and through the bottom surface of the sole layer to contact a ground surface. The pin plate may be molded into the sole layer or attached by other mechanisms. The one or more pins may be studs, spikes, screws, etc., for example. The pins may also be made of a variety of materials (e.g., metal alloys, aluminum, tungsten, stainless steel, plastic, or other suitable materials). There may be one pin centered and embedded in each pin plate, or more than one pin in embedded in each pin plate.

In the implementation shown in FIG. 4, there are two pins depicted in the overshoe 100, extending out of the bottom surface of lug portion 416 of the sole layer 404, and protruding from the pin plates 406.

The pins (or cleats), which can vary in number, provide traction in the overshoe 400. In one implementation, a pin is permanently molded into a pin plate, and the pin plate is permanently molded into the sole layer. As a result, this configuration provides aggressive snow tread and improved spike retention preventing loss of pins (or spikes).

In one implementation, an overshoe may have 26 exposed tungsten carbide pins and corresponding pin plates. The pins can vary in distance projecting from the corresponding lugs of the overshoe 400 (e.g., 1 mm, 2 mm, etc.). For example, a pin projection of about 2.5 mm offers aggressive traction. In another example, a pin projection of about 1 mm offers sufficient traction and can be used for walking indoors or for transitional traction (i.e., fraction in both indoor and outdoor environments).

In one implementation, the pins may be separate components from the pin plates and attached to the pin plates by interference fit, molding, or other means. For example, the pins may be metal pins that are molded into plastic pin plates. Molding of the pins into the pin plates in a fixed arrangement provides durability and allows users to use the overshoe 400 with confidence.

As shown in FIG. 4, the pins 408 may be positioned in the pin plates 406, wherein a majority of each pin 408 is located in the pin plate 406, and a smaller portion of each pin 408 protrudes down through the bottom surface of the lug portions 416 of the sole layer 404, and into a ground surface during use. In another implementation, the pin plates may be located in a variety of configurations in the sole layer 404 and the upper layer 402. The pin plates may be positioned entirely in the sole layer 404, with the upper layer 402 having contact with only the top surface of the pin plates. In yet another implementation, the pin plates may be located in both the sole layer 404, and the upper layer 402.

Figure 5:
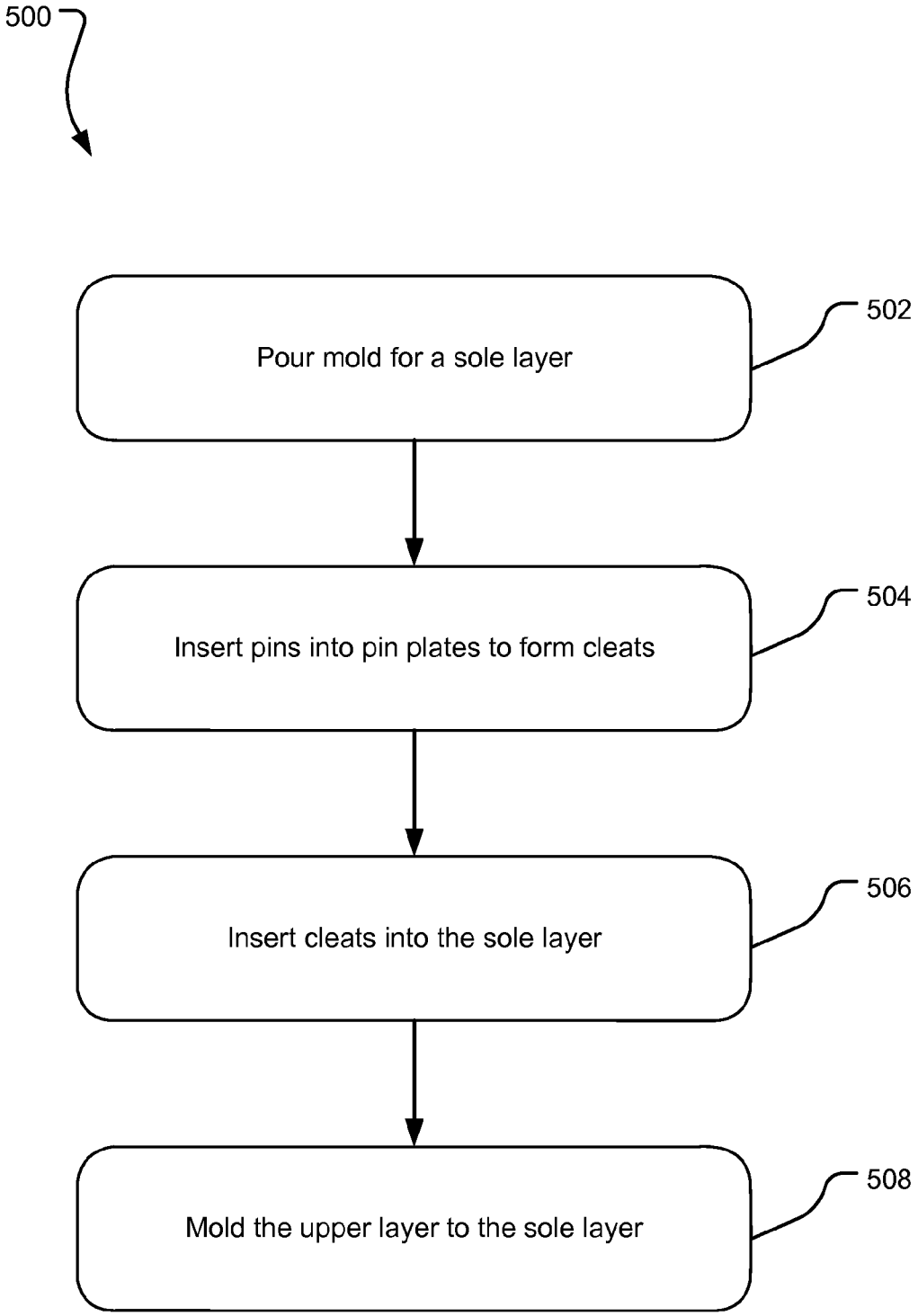
FIG. 5 shows example operations for manufacturing an example dual-molded layer overshoe.

FIG. 5 shows example operations 500 for manufacturing an example dual-molded layer overshoe. A first molding operation 502 pours a mold to make a sole layer of the dual-molded layer overshoe.

A first insertion operation 504 inserts pins into pin plates to form cleats. The pins can be of varying height (e.g., 1 mm, 2.5 mm, etc.). The pins can be inserted into pin plates by molding the pins into the pin plates in a fixed arrangement. Molding of the pins into the pin plates in a fixed arrangement provides maximum durability and allows users to use the overshoe with confidence.

The pins may be studs, spikes, screws, etc. The pins may also be made of a variety of materials (e.g., metal alloys, aluminum, tungsten, stainless steel, plastic, or other suitable materials). There can be any number of pins and pin plates (e.g., 26 pins and 26 pin plates), however, each pin plate comprises one pin. The pins are inserted to extend from inside through the bottom surface of the sole layer of the overshoe to contact a ground surface.

In another implementation, the pins and pin plates are one component. For example, a cleat can comprise of a pin and a base pin plate, all in one configuration and material. The cleats contact a ground surface and grip the surface providing traction during use.

In another implementation, the pins may be inserted in the pin plates, wherein a majority of each pin is positioned in the pin plate, and the smaller portion of each pin protrudes down through the bottom surface of the lug portions of the sole layer, and into a ground surface during use. In another implementation, the pin plates may be located in a variety of configurations in the sole layer and the upper layer. The pin plates may be positioned entirely in the sole layer, with the upper layer having contact with only the top surface of the pin plates. In yet another implementation, the pin plates may be located in both the sole layer, and the upper layer.

A second insertion operation 506 inserts the cleats into the sole layer. The cleats can be molded into the sole layer, or attached by other means. The pin plates of the cleats can be positioned completely in the sole layer, wherein the top surfaces of the pin plates are level with the top surface of the sole layer. Or, in another implementation, part of the pin plates can remain above the top surface of the sole layer. When the pin plates, which have the pins attached, are inserted into the sole layer, the pins forcibly protrude through the bottom surface of the sole layer. In some implementations, the pin plates will be inserted into lug portions of the sole layer and the pins will forcibly protrude through the bottom surface of lug portions of the sole layer.

In an implementation using cleats, the cleats are inserted into the sole layers, positioned wherein the rigid projections of the cleats extend through the bottom of the sole layer. In some implementations, the cleats may protrude through a relatively flat, bottom surface of the sole layer. In another implementation, the cleats may protrude through a lug portion of the sole layer.

A second molding operation 508 molds an upper layer to the sole layer. The upper layer is a lower durometer than the sole layer. In the implementation where the top surfaces of the pins plates are level with the top surface of the sole layer, the upper layer covers the top surfaces of the pin plates. In the implementation where part of the pin plates remain above the top surface of the sole layer, the upper layer is molded directly (e.g., no glue, adhesives, etc. are used) on top and around the pin plates, and onto the sole layer.

Once assembled, the dual-molded layer overshoe comprises of a sole layer attached to the bottom of an upper layer of lower durometer measurement. A plurality of pins protrudes from pin plates through the bottom surface of lug portions of the sole layer to contact a ground surface during use. Significant elasticity in the lower durometer upper layer provides improved cold weather flexibility and stretch for removal and installation. Reduced elasticity in the higher durometer sole layer offers greater durability in terms of cleat (or pin) retention and abrasion resistance.

The specific steps discussed with respect to each of the implementations disclosed herein are a matter of choice and may depend on the materials utilized and/or the topography-related requirements of a given system. The steps discussed may be performed in any order, adding and omitting as desired, unless explicitly claimed otherwise or a specific order is inherently necessitated by the claim language. The above specification, examples, and data provide a complete description of the structure and use of exemplary implementations of the invention. Since many implementations of the invention can be made without departing from the spirit and scope of the invention, the invention resides in the claims hereinafter appended.

What is claimed is:

1. An overshoe comprising:

a cleat;

a sole layer configured to receive the cleat; and an upper layer including portions that cover and secure a top and sides of a footwear, wherein the upper layer is molded to the sole layer and the upper layer has a lower durometer measurement than the sole layer, and wherein the cleat is secured between the sole layer and the upper layer.

2. The overshoe of claim 1, further comprising one or more additional cleats.

3. The overshoe of claim 1, wherein the cleat is secured between a top surface of the sole layer and a bottom surface of the upper layer.

4. The overshoe of claim 1, wherein the cleat is one continuous component.

5. The overshoe of claim 3, wherein the cleat comprises a pin fixed to a pin plate, wherein the pin protrudes from the pin plate and through the bottom surface of the sole layer to contact a ground surface during use of the overshoe.

6. The overshoe of claim 5, wherein the cleat further comprising one or more additional pins fixed to the pin plate.

7. The overshoe of claim 5, wherein the pin is metal and the pin plate is plastic.

8. The overshoe of claim 5, wherein the pin protrudes a distance from a lower surface of the sole layer from about 1 mm to 2.5 mm.

9. The overshoe of claim 1, wherein the upper layer is elastic.

10. The overshoe of claim 1, wherein the cleat is located in a lug portion of the sole layer.

11. The overshoe of claim 1, wherein the durometer of the upper layer lies within a range of 30-50 A.

12. The overshoe of claim 1, wherein the durometer of the sole layer lies within a range of 75-95 A.

13. A dual-molded layer overshoe, comprising:

a plurality of pin plates;

a sole layer, configured to receive the plurality of pin plates;

a plurality of pins, wherein each of the pins are embedded within one of the plurality of pin plates and protrude from the pin plates through a bottom surface of the sole layer; and an upper layer including portions that cover and secure a top and sides of a footwear, wherein the upper layer is molded directly to the sole layer over the plurality of pin plates and the upper layer has a lower durometer measurement than the sole layer, and wherein the plurality of pin plates is secured between the sole layer and the upper layer.

14. A method of manufacturing a dual molded layer overshoe, comprising:

molding a sole layer of the overshoe;

inserting a cleat through a top surface of the molded sole layer; and molding an upper layer of the overshoe to the molded sole layer, wherein the molded upper layer is oriented over the cleat, the molded upper layer includes portions that cover and secure a top and sides of a footwear, and the molded upper layer has a lower durometer than the molded sole layer, and wherein the cleat is secured between the sole layer and the upper layer.

15. The method of manufacturing the dual-molded layer overshoe of claim 14, further comprising embedding a pin into a pin plate to form the cleat.

16. The method of manufacturing the dual-molded layer overshoe of claim 15, wherein more than half of a length of the pin is embedded in the pin plate.

17. The method of manufacturing the dual-molded layer overshoe of claim 15, wherein the pin protrudes a distance from a lower surface of the molded sole layer of about 1 mm.

18. The method of manufacturing the dual-molded layer overshoe of claim 15, wherein the pin protrudes a distance from a lower surface of the molded sole layer of about 2.5 mm.

19. The method of manufacturing the dual-molded layer overshoe of claim 15, wherein inserting the cleat through the top surface of the molded sole layer results in a portion of the pin protruding through the bottom of the molded sole layer to contact a ground surface during use of the overshoe.

20. The method of manufacturing the dual-molded layer overshoe of claim 14, wherein the molding the sole layer includes molding a lug portion in the sole layer, the lug portion configured to receive the cleat prior to molding the upper layer of the overshoe.

* * * * *